US008756895B1

(12) United States Patent
Sidhu et al.

(10) Patent No.: US 8,756,895 B1
(45) Date of Patent: Jun. 24, 2014

(54) TRUSS REINFORCEMENT

(71) Applicant: Int'l Truss Lock Systems, Inc., Kelowna (CA)

(72) Inventors: Abtar Shar Sidhu, Kelowna (CA); Daniel Van Vliet, Jacksonville, FL (US)

(73) Assignee: Int'l Truss Lock Systems, Inc., Kelowna, BC (CA)

( * ) Notice: Subject to any disclaimer, the term of this patent is extended or adjusted under 35 U.S.C. 154(b) by 0 days.

(21) Appl. No.: 13/712,952

(22) Filed: Dec. 12, 2012

(51) Int. Cl.

| | |
|---|---|
| ***E04B 1/32*** | (2006.01) |
| ***E04B 7/08*** | (2006.01) |
| ***E04C 3/38*** | (2006.01) |
| ***E04C 3/02*** | (2006.01) |
| ***E04H 12/00*** | (2006.01) |
| ***E04B 1/38*** | (2006.01) |
| ***E04C 5/00*** | (2006.01) |

(52) U.S. Cl.
USPC ..... 52/696; 52/643; 52/712

(58) Field of Classification Search
CPC ..... E04C 3/11; E04C 3/12; E04C 3/17; E04C 3/18; E04C 3/02; E04C 2003/026; E04B 7/022; E04B 7/024; E04B 1/2604
USPC ..... 52/90.1, 92.1, 92.2, 639, 643, 693, 695, 52/696, 712, 167.3
See application file for complete search history.

(56) References Cited

U.S. PATENT DOCUMENTS

| | | | | | |
|---|---|---|---|---|---|
| 457,664 | A | * | 8/1891 | Paine | 52/695 |
| 1,106,845 | A | * | 8/1914 | Ream | 52/695 |
| 1,145,385 | A | | 7/1915 | Marble | |
| 1,558,239 | A | | 10/1925 | Costello | |
| 1,574,329 | A | | 2/1926 | White | |
| 1,642,945 | A | | 10/1926 | Davidson | |
| 1,649,226 | A | * | 11/1927 | Gstalder | 52/695 |
| 1,656,741 | A | * | 1/1928 | Lane | 52/695 |
| 1,657,243 | A | | 1/1928 | Daniels | |
| 1,729,741 | A | * | 10/1929 | Heltzel | 52/695 |
| 1,822,332 | A | * | 9/1931 | Bates, Jr. | 52/695 |
| 1,867,449 | A | | 7/1932 | Eckert | |
| 1,934,708 | A | * | 11/1933 | Hatch | 52/695 |
| 2,110,863 | A | | 3/1938 | Barnett | |
| 2,191,979 | A | | 2/1940 | Bierbach | |
| 2,865,059 | A | | 12/1958 | Scriven | |

(Continued)

FOREIGN PATENT DOCUMENTS

| | | |
|---|---|---|
| CA | 2730837 | 8/2011 |
| FR | 2602533 | 2/1988 |

(Continued)

*Primary Examiner* — Ryan Kwiecinski
(74) *Attorney, Agent, or Firm* — Richard D. Okimaw

(57) ABSTRACT

An apparatus for supporting a plurality of parallel spaced apart trusses comprises a center socket and first and second end sockets. The center socket is sized to receive a top edge of a first truss therein whereas the first and second end sockets are each sized to receive a bottom edge of adjacent second and third truss therein. The apparatus further comprises a first brace extending between the first end socket and the center socket and a second brace extending between the second end socket and the center socket. The base panel of the first and second end sockets define a first plane substantially parallel to the bottom edges of the plurality of trusses and the base panel of the center socket defines a second plane substantially parallel to the top edge of the plurality of trusses and second plane is angularly oriented relative to the first plane.

18 Claims, 7 Drawing Sheets

(56) References Cited

U.S. PATENT DOCUMENTS

| | | | | | |
|---|---|---|---|---|---|
| 2,964,807 | A | | 12/1960 | Kennedy | |
| 3,422,585 | A | | 1/1969 | Dismukes | |
| 3,423,898 | A | | 1/1969 | Tracy et al. | |
| 3,708,942 | A | | 1/1973 | Leonard | |
| 3,727,358 | A | | 4/1973 | Howell | |
| 3,959,945 | A | * | 6/1976 | Allen | 52/690 |
| 4,077,176 | A | | 3/1978 | Bauer | |
| 4,143,500 | A | * | 3/1979 | Sanford | 52/693 |
| 4,160,350 | A | | 7/1979 | Craib | |
| 4,192,118 | A | | 3/1980 | Gilb | |
| 4,230,416 | A | | 10/1980 | Gilb | |
| 4,246,736 | A | | 1/1981 | Kovar et al. | |
| 4,382,710 | A | | 5/1983 | Slowbe | |
| 4,414,785 | A | | 11/1983 | Howell | |
| 4,455,805 | A | | 6/1984 | Rionda et al. | |
| 4,561,230 | A | | 12/1985 | Rionda et al. | |
| 4,604,845 | A | | 8/1986 | Brinker | |
| 4,637,195 | A | * | 1/1987 | Davis | 52/693 |
| 4,843,726 | A | * | 7/1989 | Ward | 33/613 |
| 4,910,934 | A | | 3/1990 | Hennings | |
| RE34,022 | E | | 8/1992 | Davis | |
| 5,197,818 | A | | 3/1993 | Johnson | |
| 5,307,603 | A | | 5/1994 | Chiodo | |
| 5,375,384 | A | | 12/1994 | Wolfson | |
| 5,412,920 | A | | 5/1995 | Hess | |
| 5,448,871 | A | * | 9/1995 | Newman et al. | 52/712 |
| 5,467,570 | A | | 11/1995 | Leek | |
| 5,603,580 | A | | 2/1997 | Leek et al. | |
| 5,606,837 | A | * | 3/1997 | Holizlander | 52/693 |
| 5,653,079 | A | | 8/1997 | Loeffler et al. | |
| 5,697,725 | A | | 12/1997 | Ballash et al. | |
| 5,732,524 | A | | 3/1998 | Kalker | |
| 5,836,131 | A | | 11/1998 | Viola et al. | |
| 5,867,962 | A | | 2/1999 | Scott et al. | |
| 5,899,042 | A | | 5/1999 | Pellock | |
| 5,937,608 | A | * | 8/1999 | Kucirka | 52/695 |
| 5,996,303 | A | | 12/1999 | Pellock | |
| 6,003,280 | A | | 12/1999 | Wells | |
| 6,170,218 | B1 | | 1/2001 | Shahnazarian | |
| 6,354,055 | B1 | * | 3/2002 | Shaw et al. | 52/712 |
| 6,418,695 | B1 | * | 7/2002 | Daudet et al. | 52/677 |
| 6,758,022 | B1 | * | 7/2004 | Coll et al. | 52/690 |
| 6,837,019 | B2 | | 1/2005 | Collie | |
| 6,993,882 | B2 | * | 2/2006 | Crawford et al. | 52/696 |
| 7,090,174 | B2 | | 8/2006 | Korczak et al. | |
| 7,454,872 | B2 | | 11/2008 | Cutforth | |
| D607,711 | S | | 1/2010 | Adams et al. | |
| 7,716,877 | B2 | * | 5/2010 | Gilstrap et al. | 52/92.2 |
| 7,885,867 | B2 | | 2/2011 | Krystek et al. | |
| 8,302,360 | B2 | | 11/2012 | Legnini | |
| 8,443,568 | B2 | * | 5/2013 | Lin | 52/690 |
| 2002/0092259 | A1 | * | 7/2002 | Crawford et al. | 52/696 |
| 2003/0079419 | A1 | * | 5/2003 | Shamroukh et al. | 52/79.1 |
| 2005/0224667 | A1 | | 10/2005 | Whale et al. | |
| 2006/0059794 | A1 | * | 3/2006 | Gilstrap et al. | 52/90.1 |
| 2007/0044419 | A1 | * | 3/2007 | Koetter | 52/696 |
| 2012/0180422 | A1 | * | 7/2012 | Noturno | 52/696 |

FOREIGN PATENT DOCUMENTS

| | | | |
|---|---|---|---|
| GB | 425624 | | 3/1935 |
| GB | 2451686 | | 2/2009 |
| WO | 2005007983 | | 1/2005 |
| WO | 2008/141117 | A1 | 11/2008 |
| WO | WO 2009/094303 | A2 | 7/2009 |
| WO | 2011057377 | | 5/2011 |

* cited by examiner

TRUSS REINFORCEMENT

BACKGROUND OF THE INVENTION

1. Field of Invention

The present invention relates to structural reinforcement in general and in particular to a method and apparatus for reinforcing adjacent roof trusses to each other.

2. Description of Related Art

In the field of construction, it is often desirable to make a structure as strong as possible. The strength of a building is desirable for the purposes of load bearing ability as well as resistance to outside loads such as earthquakes, wind and other environmental loading.

In particular, roof construction is commonly formed of a plurality of planar trusses formed of wood metal or the like. One difficulty of such construction types is that the planar trusses, although strong in supporting vertical loads are relatively weak in resisting horizontal or shear loads by comparison.

Conventional methods of reinforcing trusses have not been adequate to resolve the above difficulties. Commonly, a sheathing or decking material, such as plywood is applied over the trusses to provide additional rigidity to such a structure. The use of decking material to provide needed strength for roof joists, although assisting with resisting forces to alter spacing between the trusses, does not provide a substantial degree of resistance to lateral loads such as experienced during some natural disasters, such as, earthquakes or windstorms.

SUMMARY OF THE INVENTION

According to a first embodiment of the present invention there is disclosed an apparatus for supporting a plurality of parallel spaced apart trusses each truss having top and bottom edges wherein the top edge is angularly oriented relative to the bottom edge. The apparatus comprises a center socket comprising a base panel and first and second side panels extending from the base panel and first and second end sockets each comprising a base panel and first and second side panels extending from the base panel. The center socket is sized to receive a top edge of a first truss therein whereas the first and second end sockets are each sized to receive a bottom edge of adjacent second and third truss therein. The apparatus further comprises a first brace extending between the first end socket and the center socket and a second brace extending between the second end socket and the center socket. The base panel of the first and second end sockets define a first plane substantially parallel to the bottom edges of the plurality of trusses and the base panel of the center socket defines a second plane substantially parallel to the top edge of the plurality of trusses and second plane is angularly oriented relative to the first plane.

The first and second braces may comprise substantially rigid elongate members. The first brace may extend from one of the first or second side panels of the first end socket and one of the first or second side panels of the center socket. The second brace may extend from one of the first or second side panels of the second end socket and one of the first or second side panels of the center socket. At least one of the first and second braces may be secured to the center socket by fasteners.

The first and second braces may be formed of a continuous material with the first and second end sockets and the center socket. The first and second end sockets, the center socket and the first and second braces may be formed from a sheet of material. The sheet of material may comprise a metal. The first and second planes may be angularly oriented relative to each other by an incline angle selected to be between 4 and 45 degrees.

The first or second side panels of the first and second end sockets may include a tab extending therefrom operable to secure the first or second end socket to an adjacent socket. The tabs may include fastener apertures extending therethrough.

The first and second braces may include fastener apertures extending therethrough proximate to the first and second end sockets operable to secure the first or second end socket to an adjacent socket. The first and second braces may include connection bores extending therethrough for pivotally fastening each of the first and second braces to an adjacent first or second brace.

The first and second side panels of each of the first and second end sockets and the center socket may be spaced apart by a distance selected to correspond to the width of the trusses. At least one of the first or second side panels of the first and third sockets may include a securing aperture for fastening the side panels to the truss. The securing aperture may comprise a slot.

The first and second side panels may extend substantially perpendicularly from the base panel. The first and second end socket may have openings oriented in a direction generally towards the center socket and wherein the center socket has an opening oriented in a direction generally towards the end sockets.

According to a first embodiment of the present invention there is disclosed a method for supporting a plurality of parallel spaced apart trusses each having top and bottom edges wherein the top edge is angularly oriented relative to the bottom edge. The method comprises locating a downwardly oriented center socket of an apparatus above a first truss such that first and second braces having first and second upwardly oriented end sockets located at distal ends thereof extend to either side of the first truss and slidably translating the apparatus in a direction towards a wider end of the truss until the first and second end sockets are engaged upon bottoms edges of side trusses located to either side of the center truss. The a base panel of first and second end sockets define a first plane substantially aligned with the bottom edge of the side trusses and a base panel of the center socket defines a second plane substantially aligned with the top edge of the center truss wherein the second plane is angularly oriented relative to the first plane.

The method may further comprise connecting at least one of the first or second end sockets to an adjacent end socket of an adjacent apparatus. The method may further comprise connecting at least one of the first or second braces to a crossing first or second brace of an adjacent apparatus.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
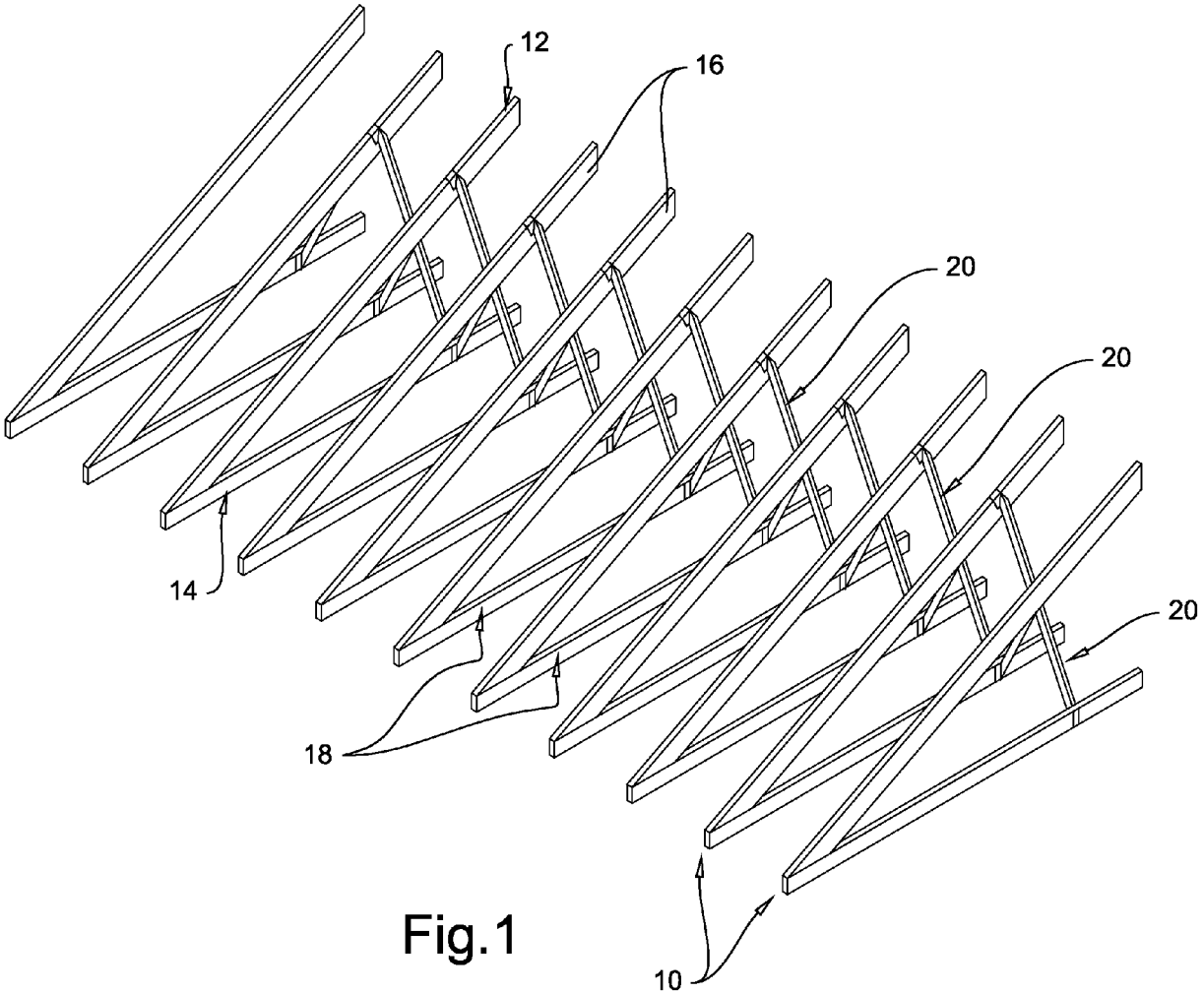
FIG. 1 is a perspective view of a plurality of apparatuses according to a first embodiment of the present invention for reinforcing structural members as located between trusses.

Referring to FIG. 1, an apparatus for stabilizing adjacent roof trusses 10 according to a first embodiment of the invention is shown generally at 20. Each roof truss 10 extends between top and bottom edges 12 and 14 and may be formed of a top sloped member 16 and a bottom substantially horizontal member 18. The truss 10 may be of any known type and may include top and bottom members 16 and 18 formed of any commonly utilized material such as, dimensioned lumber, laminated wood, oriented strand board, composite materials, engineered wood products or metal. The apparatus 20 extends between the top edge 12 of one truss and the bottom edges 14 of each adjacent truss 10 so as to brace and secure the trusses to each other and thereby to resist any lateral or rotational loads placed upon the trusses.

Figure 2:
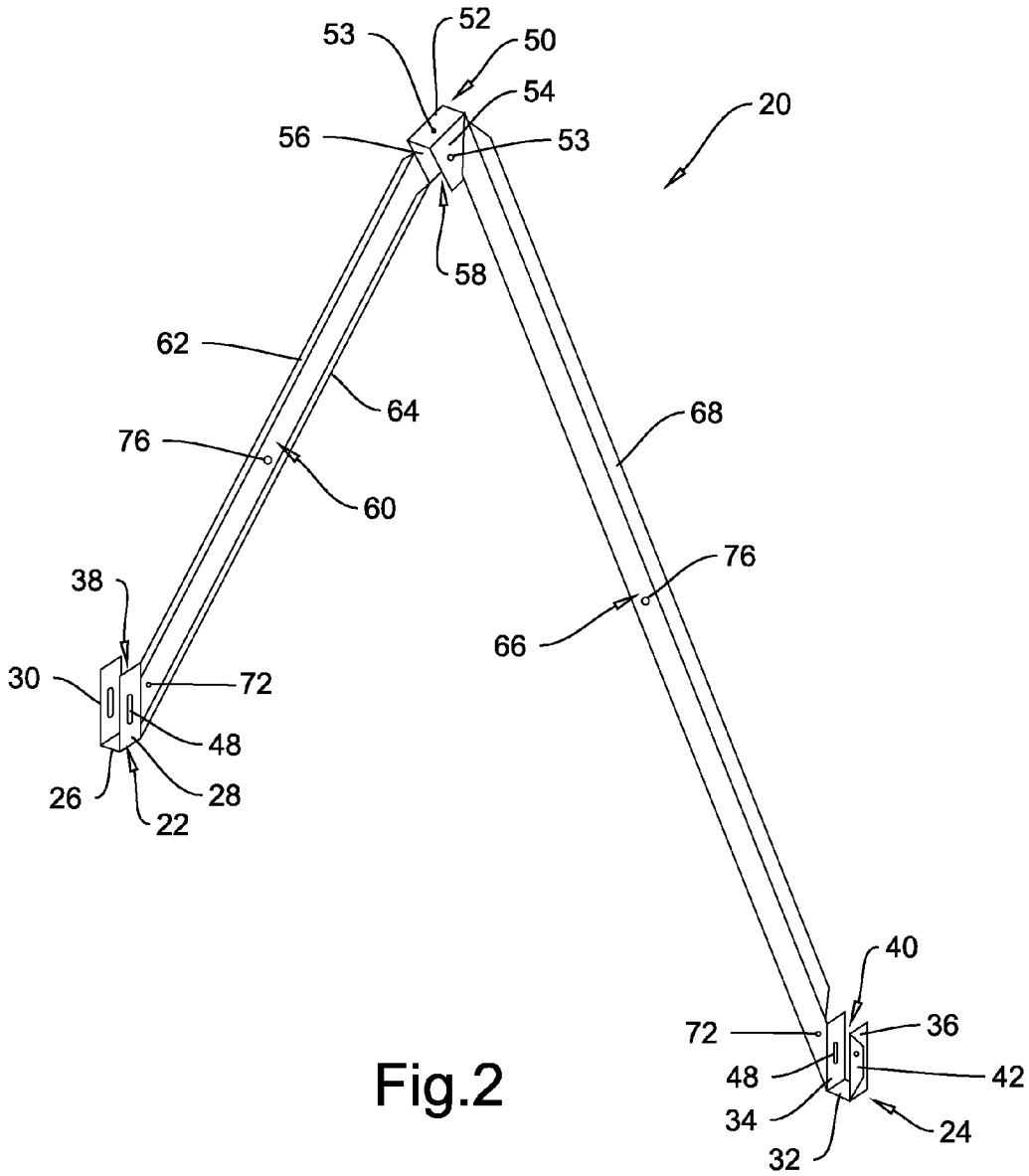
FIG. 2 is a front perspective view of the apparatus of FIG. 1.

Turning now to FIG. 2, a perspective view of an apparatus 20 according to a first embodiment of present invention is illustrated. The apparatus 20 comprises first and second end sockets, 22 and 24, respectively and a center socket 50 connected by first and second substantially rigid elongate members or braces, 60 and 66, respectively. The first and second end sockets 22 and 24 receive the bottom edges 14 of the trusses therein while the center socket 50 extends over and receives the top edge 12 of the truss therein. The first and second end sockets 22 and 24 and center socket 50 are sized to receive the bottom edges 14 and top edges, respectively, of the truss 10 firmly therein so as to resist any lateral movements of the bottom edge of the truss therein such that any lateral or twisting loads applied to the roof structure are transferred through the braces 60 and 66 to the bottom edges of adjacent trusses so as to reinforce and strengthen the resulting roof structure.

As illustrated in FIG. 2, the first and second end sockets 22 and 24 may be formed of sheet metal bent into a c-shaped channel. In particular, the first end socket 22 may be formed of a base or web panel 26 having first and second side panels, 28 and 30 extending from each side thereof. Similarly, the second end socket 24 may be formed of a base or web panel 32 having first and second side panels, 34 and 36 extending from each side thereof. As illustrated each of the base panels 26 and 32 are substantially in planar alignment with each other so as to engage upon the bottom edges 14 of the trusses and wherein each of the first and second end sockets have their corresponding first and second side panels bent in a common direction so as to surround and engage the trusses. Each of the first and second side panels 28 and 30 of the first end socket 22 and the first and second side panels 34 and 36 of the second side socket are substantially parallel to each other to correspond to the side edges of the trusses to which they are to be applied. The first and second end sockets 22 and 24 each form an opening, generally indicated at 38 and 40 respectively which is oriented in a generally upward direction when applied to a truss.

The center socket 50 may be formed of sheet metal bent into a c-shaped channel having a base or web portion 52 and first and second side panels, 54 and 56 extending from each side thereof. The first and second side panels 54 and 56 are substantially parallel with each other so as to correspond to the side edges of the trusses to which they are to be applied. The center socket forms an opening, generally indicated at 58 which is oriented in a generally downward direction when applied to a truss. In such a manner it will be observed that the center socket opening 58 is oriented in a direction generally towards the end socket openings 38 and 40 so as to retain the trusses therebetween.

The center socket and end socket openings, 58, 38 and 40 are selected to have a width corresponding to the width of the truss to which they are to be applied. In many applications, the truss 10 will be formed of a member of a wood product, such as, by way of non-limiting example dimensioned lumber, laminated wood, oriented strand board, engineered wood products or any other suitable materials including composite materials and metal. In particular, dimensioned lumber is commonly of a 1.5 inch width and therefore for such applications the socket openings, 58, 38 and 40 will be sized to have a similar width opening. It will be appreciated that other thicknesses of trusses may also be utilized, such as, by way of non-limiting example, sized to accommodate a doubled up truss, a 3½ inch wide truss or other common wood or metal floor joist sizes. In some applications, the socket openings, 58, 38 and 40 may be sized slightly larger than the width of the joist so as to facilitate installation. In particular, the socket openings, 58, 38 and 40 may be up to 3.2 mm (⅛ of an inch) larger than the joist for which they are designed. The socket openings, 58, 38 and 40 may also have heights of the side panels 28, 30, 34, 36, 54 and 56 corresponding to the heights of the top and bottom members 16 and 18 of the truss, such as, by way of non-limiting example 3½ inches (89 mm) for trusses formed of 2×4 dimension lumber although it will be appreciated that other heights may be useful as well.

The first brace 60 is formed of a substantially rigid member extending between the second side panel 56 of the center socket 50 and the first side panel 28 of the first end socket 22. As illustrated, the first brace 60 may be formed of a substantially flat planar member and may optionally have first and second side flanges, 62 and 64, respectively extending perpendicularly therefrom. The second brace 66 is formed of a substantially rigid member extending between the first side panel 54 of the center socket 50 and the first side panel 28 of the second end socket 24. As illustrated, the second brace 66 may be formed of a substantially flat planar member and may optionally have first and second side flanges, 68 and 70, respectively extending perpendicularly therefrom (only the first side flange 68 is shown in FIG. 2). The side flanges 62 and 64 extend to opposed sides of the first and second braces 60 and 66 from the side flanges 68 and 70 so as to permit successive apparatuses to be overlapped on each other as will be more fully described below. Additionally, the first end socket 22 extends to the same side of the first brace 60 as the side flanges 62 and 64 to permit similar mating with corresponding successive sockets. Similarly, the second end socket 24 extends to the same side of the first brace 60 as the side flanges 68 and 70. It will also be appreciated that one or both of the sides flanges 62, 64, 68 or 70 may be omitted depending on the strength requirements of the application. It will also be appreciated that although the first and second braces 60 and 66 are illustrated as being substantially straight, they may have any shape or path between the first and second end sockets 22 and 24 and the center socket 50. Additionally, the first and second braces 60 and 66 may be formed by connecting one or more elements together to form the final shape.

The first and second braces 60 and 66 have a length selected to extend between a top edge 12 of one truss and the bottom edge 14 of an adjacent truss as desired by a user. It will be appreciated that this length will also be dictated by the spacing between the joists. Generally, the distance between the joists, which is commonly expressed in centre to centre distance will correspond to the distance to the centres of the center socket opening 58 and the end socket openings 38 and 40. As illustrated in FIG. 1, each apparatus may be applied to a truss such that the first and second braces 60 and 66 cross each other. Each of the first and second braces 60 and 66 may optionally include interlocking bores, 76 for receiving fasteners (not shown) or the like therethrough so as to interlink the braces of adjacent apparatuses.

Figure 7:
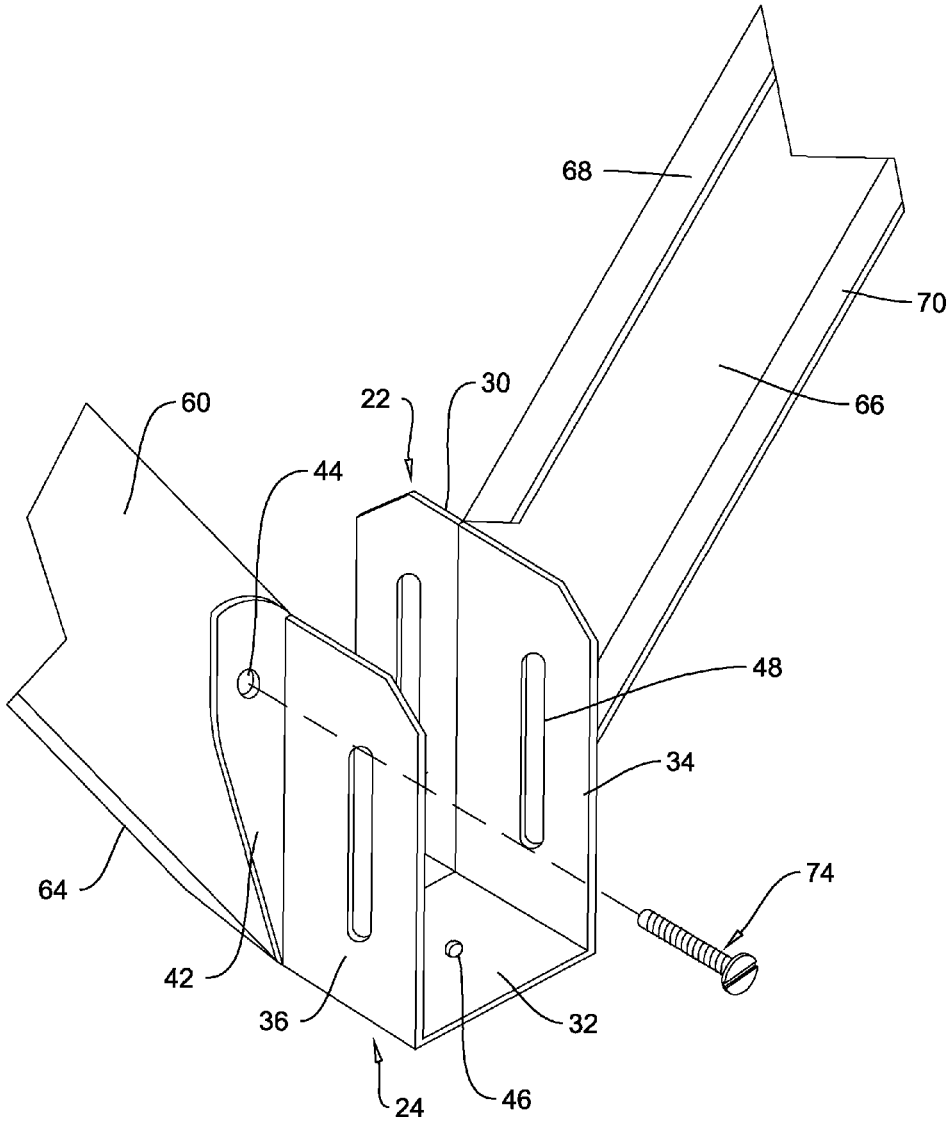
FIG. 7 is a detailed perspective view of one of the end sockets of the apparatus of FIG. 2.

As illustrated in FIG. 2, the center socket 50 may include fastener bores 53 on any of the base or side panels sized to permit nails, screws or other suitable fasteners to be passed therethrough so as to secure the center socket 50 to the truss 10. The second side panels 30 and 36 of the first and second end sockets 22 and 24 may optionally include a connecting tab 42 extending therefrom along a common plane with the first and second braces 60 and 66. As illustrated, the connecting tabs 42 may have a circular or rounded outline although it will be appreciated that other shapes may be useful as well, such as, by way of non-limiting example, square, triangular, octagonal or irregular. The connecting tab 42 may include a connecting bore 44 therethrough. Similarly, the first and second braces may include connecting bores 72 therethrough proximate to the first and second end sockets 22 and 24 such that when a first socket of one apparatus is located adjacent to a second socket of a second socket a fastener 74 may be passed therethrough as illustrated in FIG. 7. The base panels 32 and 26 of the first and second sockets may include fastener bores 46 extending therethrough sized to permit nails, screws or other suitable fasteners to be passed therethrough so as to secure the first and second end sockets 22 and 24 to the truss 10. The first and second side panels 34 and 36 of the end pockets may also include securing apertures 48 extending therethrough operable to receive fasteners (not shown) therethrough. As illustrated the securing apertures 48 may comprise slots, although it will be appreciated that other shapes, such as, by way of non-limiting example regular or irregular bores may be utilized as well. Optionally, any of the panels forming the first and second end sockets 22 and 24 and center socket may include barbs, spikes or other suitable projections from an interior surface thereof so as to engage the truss when the apparatus 20 is secured thereto. Adhesives may also be applied between the top and bottom edges 12 and 14 of the truss and the end or center sockets 22, 24 or 50.

Figure 5:
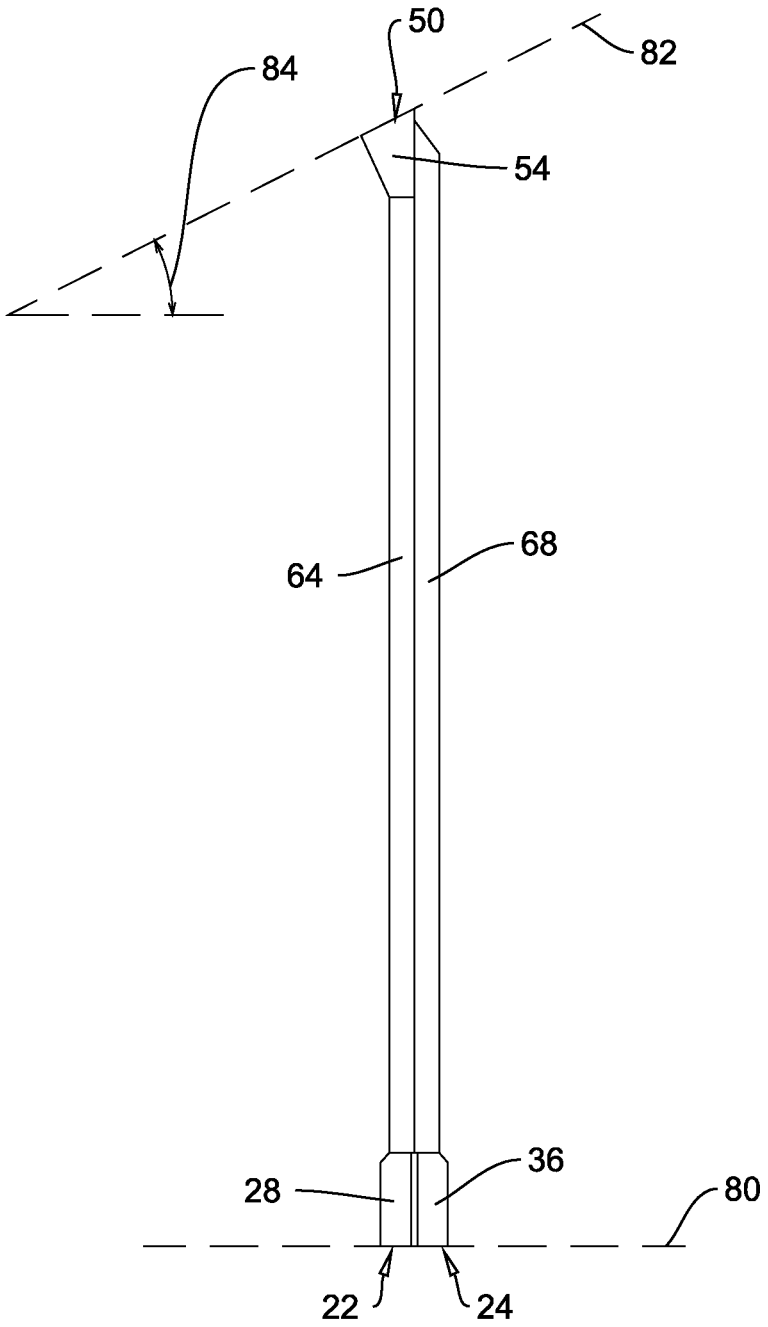
FIG. 5 is a side elevation view of the apparatus of FIG. 2.

As illustrated in FIGS. 2 and 5, the end sockets 22 and 24 define a common bottom plane, generally indicated at 80. Furthermore, the center sockets define a top plane generally indicated at 82. The bottom plane is substantially horizontal whereas the top plane is angularly oriented relative to the bottom plate by an inclination angle generally indicated at 84. The inclination angle 84 will be selected to correspond to the pitch of the roof, such as, by way of non-limiting example between 4 an 45 degrees although it will be appreciated that other angles may be useful as well.

The apparatus 20 may be formed of a rigid or resilient flexible members such as, metal straps, bars, chain and the like, by way of non-limiting example. The apparatus may be formed of any suitable thickness of metal as required to provide the necessary strength may be utilized such as between 12 and 22 gauge. In particular, it has been found that sheet metal of between 16 and 20 gauge has been useful. It will also be appreciated that the apparatus 20 may also be formed of non-metal materials, such as, by way of non-limiting example, carbon fibre, fibreglass, plastics, ceramics and composite materials. It will also be appreciated that although c-shaped channels are illustrated and described above for braces 60 and 66, other cross-section shapes may be utilized as well, such as, by way of non-limiting example, bar, tube, box section, I-beam, c-shaped channel, L-shaped channel, a triangular cross section beam, or any other suitable member. It will also be appreciated that although elongate, substantially straight members are shown, non-straight members may also be utilized, such as, by way of non-limiting example, arcuate, space frame, plates or any other shape as long as the end sockets 22 and 24 are rigidly translationally fixed relative to the center socket so as to securely locate top and bottom edges 14 of adjacent structural member relative to each other.

Figure 3:
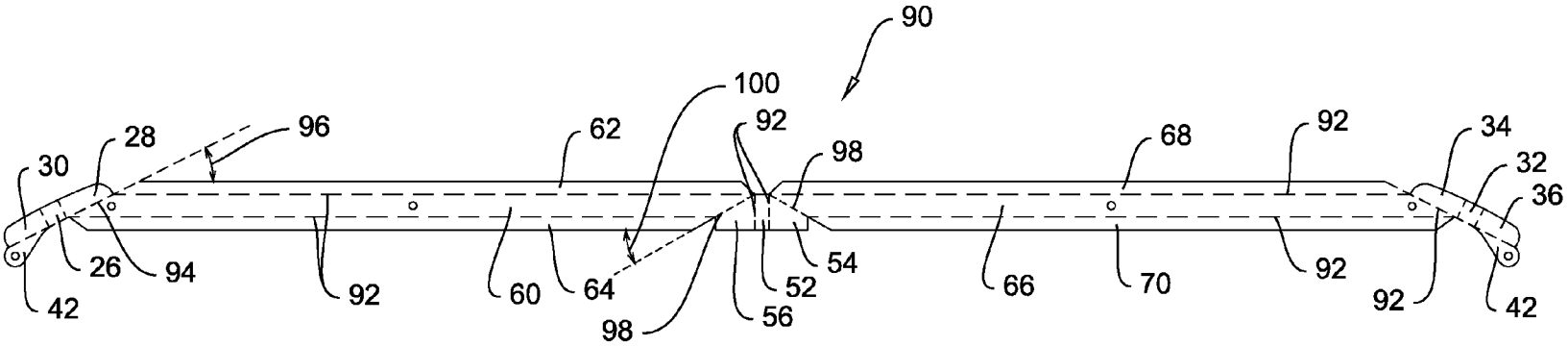
FIG. 3 is a plan view of a cut sheet useful for forming the apparatus of FIG. 2.
Figure 4:
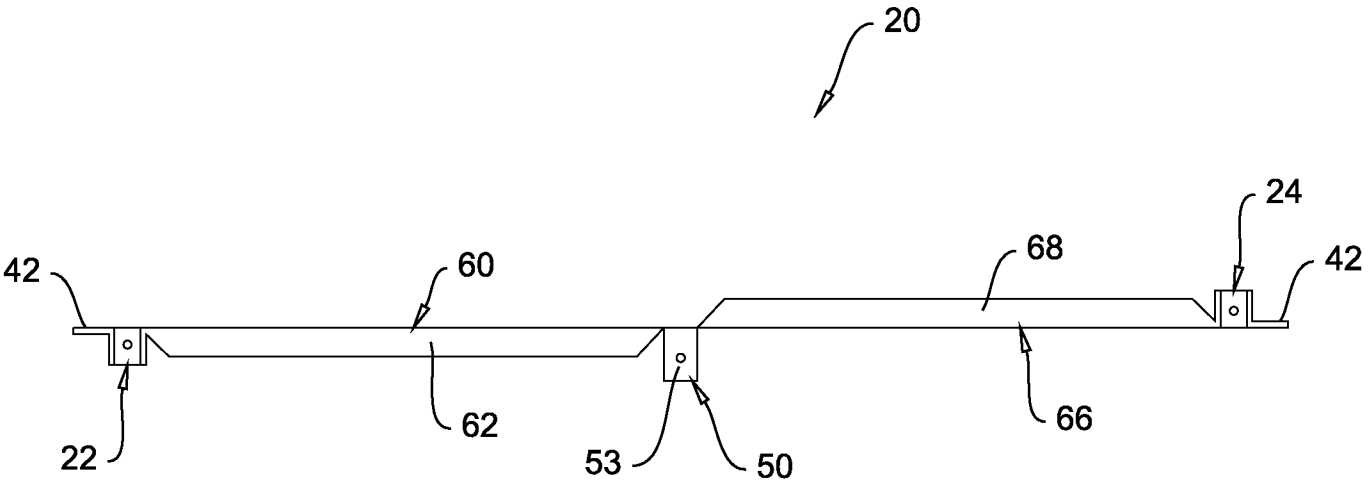
FIG. 4 is a top plan view of the apparatus of FIG. 2.

With reference to FIG. 3, the apparatus 20 may be cut from a single sheet of metal, such as, by way of non-limiting example, steel, stainless steel, aluminium or galvanized steel. The sheet metal may be cut into a blank 90 as illustrated in FIG. 3 according to known methods and thereafter bend into the desired shape as illustrated and described above. Thereafter, the blank may be bent along bend lines 92 to form the apparatus 20 as set out above. In particular, the end socket bend line 94 between the first end socket 22 and the first brace 60 as well as between the second end socket 24 and the second brace 66 is selected to be oriented relative to the brace 60 along an end socket angle, generally indicated at 96. The end socket angle 96 will be selected to permit the brace 60 to extend angularly between the end socket 22 and the center socket 50 as illustrated in FIGS. 1 and 2 based upon the spacing between the trusses as well as the height of the trusses at the location the apparatus is intended to be located and may also be adjusted to permit the end sockets 22 to be angularly oriented relative to the horizontal, such as for use with a cathedral or vaulted ceiling or for use with scissor trusses as are commonly known. Furthermore, the blank 90 may include a center socket bend line 98 between the center socket 50 and the first and second braces 60 and 66 oriented relative to the brace 60 along a center socket bend angle, generally indicated at 100. The center socket angle 100 will be selected to permit the brace 60 to extend angularly between the end socket 22 and the center socket 50 as illustrated in FIGS. 1 and 2 based upon the spacing between the trusses as well as the height of the trusses at the location the apparatus is intended to be located. The center socket angle will also be adjusted to align the center socket along the top member 16 of the truss according to known methods. Although the first and second braces are illustrated as extending from opposite sides of the center socket 50 of the blank along aligned paths in FIG. 3, it will be appreciated that for some roof pitches, spacing and heights, the first and second braces 60 and 66 will extend angularly from the center socket.

It will also be appreciated that although the apparatus 20 may be formed of bent sheet metal as described above, it may also be formed by other means such as an extruded, cast or welded structure. It will also be appreciated that one or both of the first and second braces 60 and 66 may be co-formed with the center socket 50 or may optionally be formed separately and thereafter secured thereto with fasteners, adhesives, welding or the like.

Figure 6:
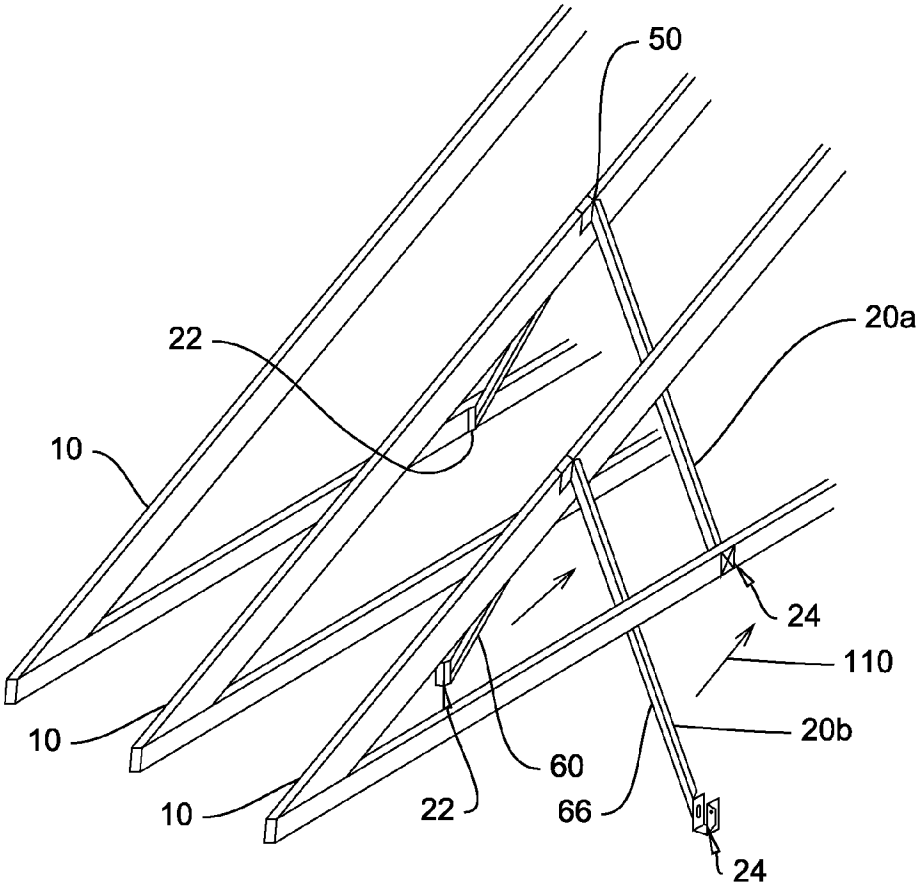
FIG. 6 is a perspective view of a first apparatus according to FIG. 2 secured between three trusses and a second apparatus according to FIG. 2 being applied thereto to interlock with the first apparatus.

In operation, a first apparatus 20*a* may be located on a truss with the center socket engaged over the top edge 12 of the truss. The apparatus may thereafter be moved in a direction towards a wider end of the truss, generally indicated at 110 in FIG. 6 until the end sockets are engaged upon the bottom edges 14 of the trusses to either side of the first truss. Optionally, the first and second end sockets may be engaged upon an intermediate truss member for application to tall trusses. Thereafter successive apparatuses 20*b* may be applied to the adjacent trusses as illustrated in FIG. 6 until each truss has an apparatus suspended from the top edge thereof. The braces 60 and 66 may then be secured to each other through the interlocking bores and the end sockets secured to each other as illustrated in FIG. 7.

While specific embodiments of the invention have been described and illustrated, such embodiments should be considered illustrative of the invention only and not as limiting the invention as construed in accordance with the accompanying claims.

What is claimed is:

1. An apparatus for supporting a plurality of parallel spaced apart trusses, each truss having top and bottom edges wherein said top edge is angularly oriented relative to said bottom edge, the apparatus comprising:

a center socket comprising a base panel and first and second side panels extending from said base panel, said center socket being sized to receive a top edge of a first truss therein;

first and second end sockets each comprising a base panel and first and second side panels extending from said base panel, each of said first and second end sockets being sized to receive a bottom edge of an adjacent second and third truss therein;

a first brace extending between said first end socket and said center socket wherein said first brace includes a web portion extending along a vertical plane; and a second brace extending between said second end socket and said center socket wherein said second brace includes a web portion extending along a vertical plane, wherein said base panel of said first and second end sockets define a first plane substantially parallel to said bottom edges of said plurality of trusses and said base panel of said center socket defines a second plane substantially parallel to said top edge of said plurality of trusses, wherein said second plane is angularly oriented relative to said first plane.

2. The apparatus of claim 1 wherein said first and second braces comprise a substantially rigid elongate member.

3. The apparatus of claim 2 wherein said first brace extends from one of said first or second side panels of said first end socket and one of said first or second side panels of said center socket.

4. The apparatus of claim 2 wherein said second brace extends from one of said first or second side panels of said second end socket and one of said first or second side panels of said center socket.

5. The apparatus of claim 2 wherein at least one of said first and second braces are secured to said center socket by fasteners.

6. The apparatus of claim 2 wherein said first and second braces are formed of a continuous material with said first and second end sockets and said center socket.

7. The apparatus of claim 6 wherein said first and second end sockets, said center socket and said first and second braces are formed from a sheet of material.

8. The apparatus of claim 7 wherein said sheet of material comprises a metal.

9. The apparatus of claim 8 wherein said first and second planes are angularly oriented relative to each other by an incline angle selected to be between 4 and 45 degrees.

10. The apparatus of claim 1 wherein said first or second side panels of said first and second end sockets include a tab extending therefrom operable to secure said first or second end socket to an adjacent socket.

11. The apparatus of claim 10 wherein said tabs include fastener apertures extending therethrough.

12. The apparatus of claim 1 wherein said first and second braces include fastener apertures extending therethrough proximate to said first and second end sockets operable to secure said first or second end socket to an adjacent socket.

13. The apparatus of claim 1 wherein said first and second braces include connection bores extending therethrough for pivotally fastening each of said first and second braces to an adjacent first or second brace.

14. The apparatus of claim 1 wherein said first and second side panels of each of said first and second end sockets and said center socket are spaced apart by a distance selected to correspond to the width of the trusses.

15. The apparatus of claim 14 wherein said first and second side panels extend substantially perpendicularly from said base panel.

16. The apparatus of claim 1 wherein at least one of said first or second side panels of said first and second sockets includes a securing aperture for fastening said side panels to said truss.

17. The apparatus of claim 16 wherein said securing aperture comprises a slot.

18. The apparatus of claim 1 wherein said first and second end sockets have openings oriented in a direction towards said center socket and wherein said center socket has an opening oriented in a direction generally towards said first and second end sockets.

* * * * *